US011776510B2

(12) United States Patent
Liu

(10) Patent No.: US 11,776,510 B2
(45) Date of Patent: Oct. 3, 2023

(54) IMAGE UPDATE METHOD FOR A DISPLAY DEVICE AND DRIVING DEVICE THEREOF

(71) Applicant: SITRONIX TECHNOLOGY CORP., Jhubei (TW)

(72) Inventor: Chih Hao Liu, Jhubei (TW)

(73) Assignee: Sitronix Technology Corp., Jhubei (TW)

( * ) Notice: Subject to any disclaimer, the term of this patent is extended or adjusted under 35 U.S.C. 154(b) by 0 days.

(21) Appl. No.: 17/023,572

(22) Filed: Sep. 17, 2020

(65) Prior Publication Data

US 2021/0264882 A1 Aug. 26, 2021

Related U.S. Application Data

(60) Provisional application No. 62/901,368, filed on Sep. 17, 2019.

(51) Int. Cl.
*G09G 5/393* (2006.01)
*G09G 3/36* (2006.01)

(52) U.S. Cl.
CPC ..... *G09G 5/393* (2013.01); *G09G 3/3618* (2013.01); *G09G 3/3688* (2013.01)

(58) Field of Classification Search
CPC .... G09G 5/393; G09G 3/3618; G09G 3/3688; G09G 5/001; G09G 5/006; G09G 5/00; G06F 3/147; H04N 5/10; G06T 13/80; G04G 21/08; H01L 27/1225
See application file for complete search history.

(56) References Cited

U.S. PATENT DOCUMENTS

2004/0125099 A1* 7/2004 Stanley ..... G09G 5/00 345/211
2007/0002036 A1* 1/2007 Kardach ..... G09G 5/006 345/213

(Continued)

FOREIGN PATENT DOCUMENTS

CN 1700299 A 11/2005
CN 104347023 A 2/2015

(Continued)

OTHER PUBLICATIONS

Office Action and Search Report for counterpart Taiwanese Application No. 109132186, dated Jun. 8, 2021.

(Continued)

*Primary Examiner* — Richard J Hong
(74) *Attorney, Agent, or Firm* — Rosenberg, Klein & Lee

(57) ABSTRACT

A screen update method for a display device and a driving device thereof, the frame update method includes: following a write-in command, controlling a driving circuit to drive a display panel to update a screen; the write-in command represents writing a display data to a storage element. The driving device includes: the driving circuit, which is coupled to the display panel and drives the display panel to update the screen; and a control circuit, which receives the write-in command and the display data, is coupled to the driving circuit; the control circuit follows the write-in command writing the display data to the storage element, and follows the write-in command to control the driving circuit to drive the display panel to update the screen.

25 Claims, 4 Drawing Sheets

(56) References Cited

U.S. PATENT DOCUMENTS

| | | | | |
|---|---|---|---|---|
| 2007/0159490 | A1* | 7/2007 | De Greef | G09G 5/393 345/546 |
| 2008/0211962 | A1* | 9/2008 | Murata | H04N 5/10 348/E5.009 |
| 2011/0115781 | A1 | 5/2011 | Park et al. | |
| 2013/0050179 | A1* | 2/2013 | Chang | G09G 5/393 345/418 |
| 2015/0221261 | A1* | 8/2015 | Asai | G09G 5/001 345/534 |
| 2016/0117978 | A1 | 4/2016 | Shikata | |
| 2017/0148417 | A1* | 5/2017 | Lee | G06F 3/147 |
| 2017/0236497 | A1* | 8/2017 | Huitema | G04G 21/08 345/173 |
| 2017/0316734 | A1 | 11/2017 | Asai et al. | |
| 2018/0033360 | A1 | 2/2018 | Bae et al. | |
| 2020/0243035 | A1* | 7/2020 | Tanaka | H01L 27/1225 |
| 2020/0294473 | A1* | 9/2020 | Tung | G06T 13/80 |

FOREIGN PATENT DOCUMENTS

| | | | |
|---|---|---|---|
| CN | 104616627 | A | 5/2015 |
| JP | 2004151222 | A | 5/2004 |
| JP | 2010128292 | A | 6/2010 |
| JP | 2012194432 | A | 10/2012 |
| TW | 201235994 | A1 | 9/2012 |

OTHER PUBLICATIONS

First Office Action mailed to corresponding Chinese Patent Application No. 202010981892.3 dated Jul. 12, 2023.

* cited by examiner

IMAGE UPDATE METHOD FOR A DISPLAY DEVICE AND DRIVING DEVICE THEREOF

FIELD OF THE INVENTION

The present invention relates to a display device, and particularly to an image update method for the display device and a driving device thereof.

BACKGROUND OF THE INVENTION

Since the display technology has been focusing to thinner, lighter and planarization, many plane panel display technologies have launched to market and compete in the market, such as the projection displays, plasma displays, liquid crystal displays (LCDs) and the latest organic light emitting diodes displays. Nowadays, it is well known that LCD devices are the mainstream products in the field of large-size, medium-size and small-size displays, and they share a very large market share, in which LCD panels are the main elements of the LCD devices and are massively sold in the form of modules.

LCD panels are not only available in various sizes, but also applications with various update rates thereof (hereinafter referred to as the frame-rate), such as the high frame-rate applications and the low frame-rate applications; when the display panel updates frames with the high frame-rate (over 30 frames per second), the frame is updated quickly that needs to provide the driving voltage with opposite polarity to the same pixel to protect the liquid crystal material from electrolysis, which causes a relatively large power consumption. Due to the aforesaid larger power consumption of high frame-rate, when LCD is used in wearable devices, such as iWatch, Mi bracelets and bluetooth headsets, the display is not limited to LCD, it may use PLED display or Mini-LED display and applies the low frame-rate to reduce power consumption. In the case of LCD, it is to minimize the frame updating amount under the premise that the liquid crystal material won't cause electrolysis.

Normally, when the frame-rate of the display device is different from the rate at which the micro controller unit (MCU) of the system transmits the updated display data, the picture displayed by the display device may be incomplete, which is usually called screen tearing, especially when the frame-rate of the display device is low, user is more likely to perceive the screen tearing and thus impacts the picture quality. One of the reasons in generating screen tearing is that the driving device of the display device, such as the display driving chip, drives the display panel to update the flame (screen), and the frequency of updating the frame (screen) is different from the frequency of transmitting the updated display data of the microprocessor. When the first frame is displayed by the display panel, the driving device drives the display panel to update the frame and display the second frame; since the microprocessor of the system has not yet transmitted the updated display data, the driving device will drive the display panel to display the second frame with the previous display data that the display panel will display the previous picture in the early part of the second frame until the microprocessor of the system has transmitted the updated display data; after that, the driving device drives the display panel to continue to display the second frame with the updated display data, which will make the picture displayed in the early part of the second frame be the picture displayed in the early part of the first frame, and the picture displayed in the remaining part of the second frame is the new picture, that is, the second frame is not the complete picture originally intended to be displayed.

To solve the aforesaid problem, it may design a synchronization circuit to synchronize the operating frequency of the driving device with the operating frequency of the system microprocessor. Yet, this synchronization circuit is complicated and will increase the cost, which is not a good solution.

Due to the aforesaid various reasons, nowadays, under diversified and vigorous development of display panel technologies, the problem of incomplete display images in various display panels is still one of the issues that various industries are striving to improve about. Therefore, the present application provides a display updating method and its driving device to solve the above problems.

SUMMARY

One objective of the present application is to provide a screen updating method for a display and a driving device thereof, which controls a driving circuit to drive the display panel and update the screen according to a write command, avoiding the problem of incomplete screen displayed on the display panel.

An embodiment of the present application discloses a screen update method for a display screen, which includes: controlling a driving circuit that drives a display panel to update a screen according to a writing-in command, in which the writing-in command represents writing a display data into a storage element.

An embodiment of the present application discloses a driving device for a display, which includes: a driving circuit coupled to a display panel that drives the display panel to update a screen; and a control circuit that receives a writing-in command and a displaying data and is coupled to the driving circuit; the display data is written into a storage element according to the writing-in command, and the driving circuit is controlled to drive the display panel to update the screen according to the writing-in command.

DETAILED DESCRIPTION

To enable the Review Committee members having deeper realization and understanding on the features and functions of the present application, we hereby put the embodiments and detailed explanation in below:

In the following statements, various embodiments of the present application will be described in detail by means of schematic interpretation. However, the concept of the present application may be embodied in many different forms and should not be limiting to the exemplary embodiments described herein.

We've used some terms in the Invention Description CLAIMs to specify certain devices; yet, anyone in the field of the present application with common knowledge shall be able to understand these terms; manufacturers might use different terms to call the same device, and the present application Description and CLAIMs don't use the name variety as the criterion of distinction, instead, the present application Description and CLAIMs use the difference in overall technology as the criterion. The "include" mentioned in the entire Invention Description and CLAIMs is an open term, which shall be explained as "include but not limited to". Moreover, the "coupled to" herein includes the direct and indirect methods. Therefore, if in there is an expression of "a primary device coupled to the secondary device", it means that the primary device is connected to the secondary device directly or via other device or connecting way that is connected to the secondary device indirectly.

The present application is a method to solve the problem of incomplete image pictures on the display panel. By adjusting the timing of the driving circuit driving the display panel to update the image pictures, the problem of incomplete image picture displayed on the display panel may be avoided. The method of updating the image picture in the present application may be applied to the display panels with any frame-ratios to improve the display quality, especially for a display panel with a low frame-ratio, which may both improve the display quality and reduce power consumption.

Figure 1:
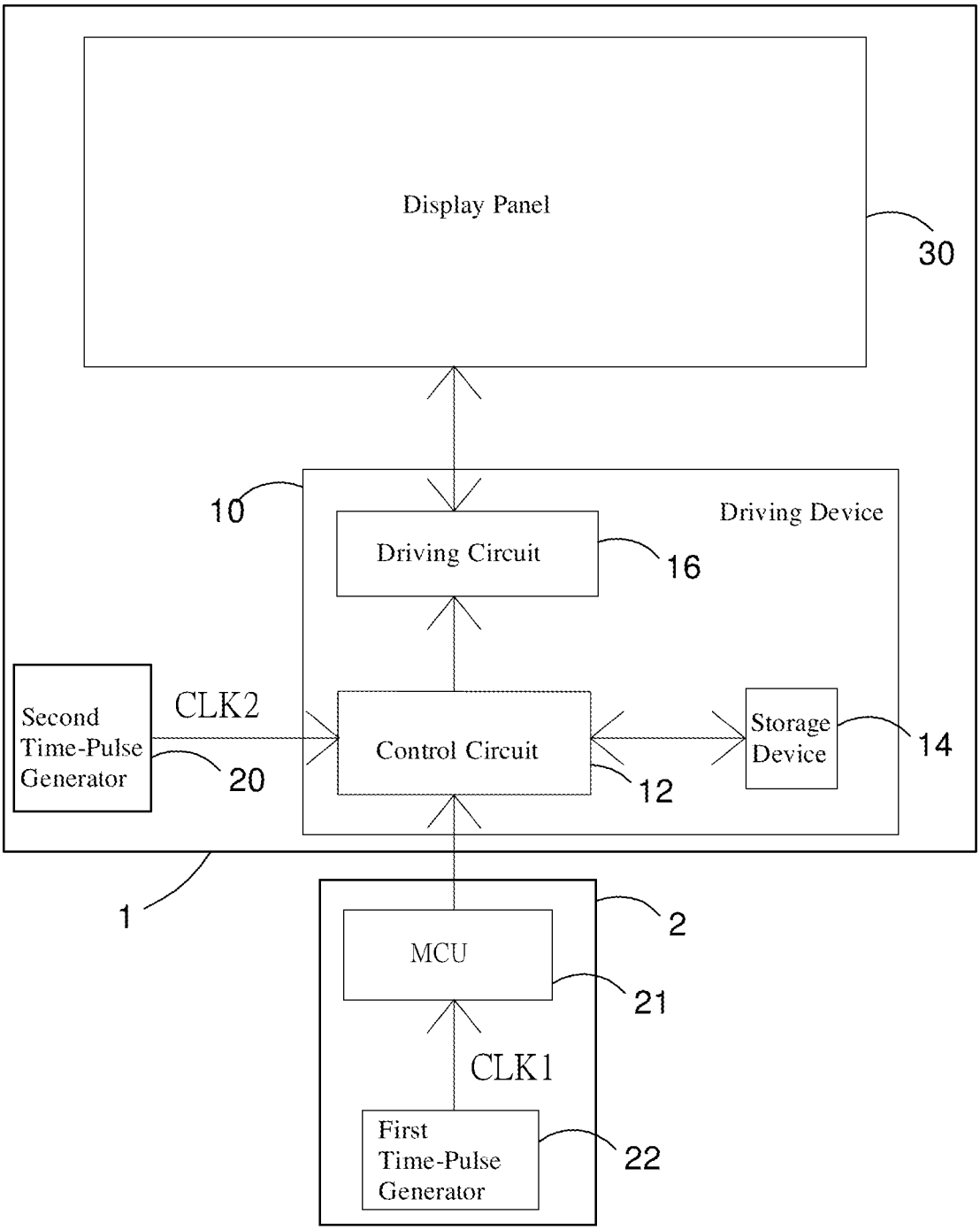
FIG. 1 shows a block diagram of display in an embodiment of the present application.

First, refer to FIG. 1, which is the block diagram of display in an embodiment of the present application. As shown in the figure, display 1 may have a driving device 10, a second pulse generator 20 and a display panel 30; the driving device 10 may have a control circuit 12, a storage element 14 and a driving circuit 16; the control circuit 12 may be coupled to a host 2, host 2 has a microcontroller unit (MCU) 21 and a first pulse generator 22; MCU 21 is coupled to the first pulse generator 22; control circuit 12 is coupled to the storage element 14, driving circuit 16 and second pulse generator 20; driving circuit 16 is coupled to the control circuit 12 and the display panel 30.

driving device 10, for example, is a LCD panel driving IC; driving circuit 16 may include a source driving circuit, a gate driving circuit and a timing control circuit (figure not shown); storage element 14, for example, is a RAM; host 2, for example, is a MCU of electronic devices.

The first pulse generator 22 generates a first pulse signal CLK1 with first frequency to MCU 21; the MCU 21 of the host 2 generates a write-in command and a display data and output the write-in command and display data to control circuit 12 according to the first pulse signal CLK1 with first frequency, which is the normally called the write-in action of MCU 21; this write-in command instructs to write the display data to storage element 14. The control circuit 12 receives the second pulse signal CLK2 with the second frequency from the second pulse generator 20; the control circuit 12 receives the write-in command and display data, writes the display data into the storage element 14 and updates the display data in storage element 14 according to the write-in command; the control circuit 12 another reads the display data from storage element 14 and transmits the display data to driving circuit 16 according to the second pulse signal CLK2 with the second frequency, controlling driving circuit 16 to drive display panel 30 to update screen image; the updated screen image is related to the second frequency; driving circuit 16 receives the display data and drives display panel 30 according to the received display data, updating the screen image picture on display panel 30, in which the first frequency isn't equal to the second frequency.

Figure 2:
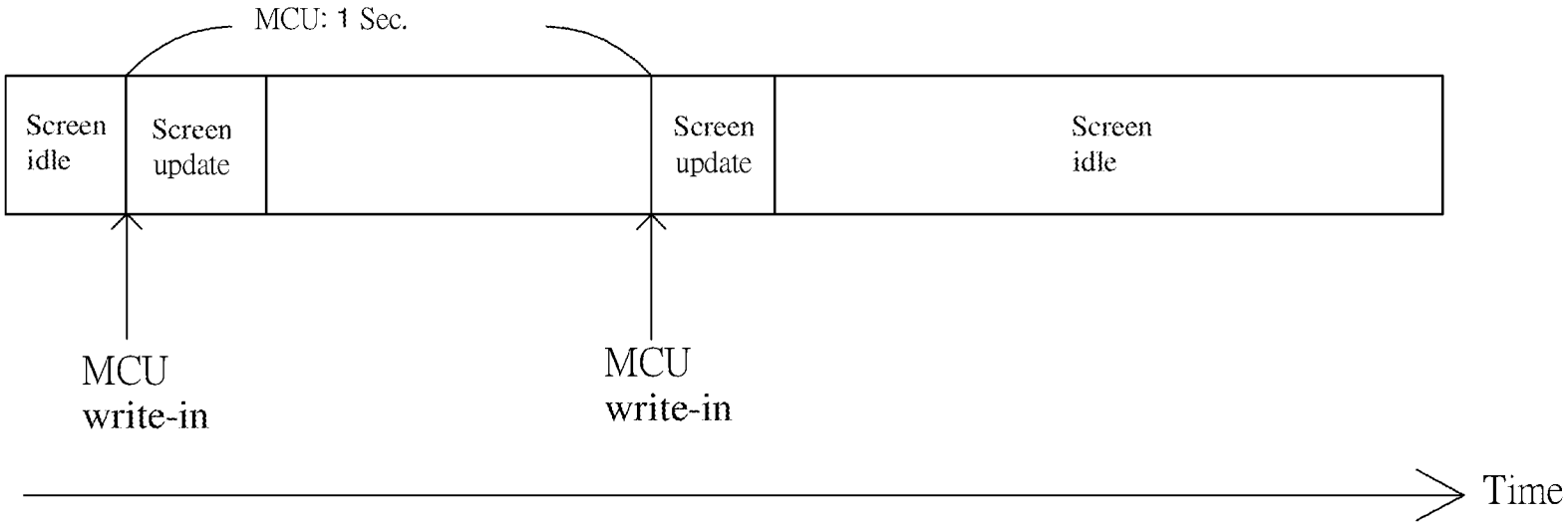
FIG. 2 shows a timing diagram of the method in updating the screen in an embodiment of the present application.

As shown in FIG. 2, in this embodiment the updating method of display panel 30 in the present application is that under the premise of not polarizing the liquid crystal material used in the LCD panel, the control circuit 12 keeps in an idle state without transmitting display data to driving circuit 16 and driving circuit 16 doesn't drive display panel 30 to update screen image; that is, in the screen updating method of this embodiment, it has no preset frame period nor preset screen updating frequency, only when MCU 21 inputs write-in command and updated display data to control circuit 12, control circuit 12 follows the write-in command controlling the driving circuit 16 to a updating state, driving display panel 30 to update screen image picture. In details, control circuit 12 writes in the updated display data into storage element 14, and control circuit 12 follows the write-in command to read the display data from storage element 14 and transmits it to driving circuit 16, controlling driving circuit 16 to drive display panel 30; display panel 30 follows the display data to drive display panel 30 and perform screen updating; after entire screen image picture updating is complete, control circuit 12, driving circuit 16 and display panel 30 come into idle state again; during the idle state time, the updated screen displayed by display panel 30 remains unchanged; driving circuit 16 remains in idle state until control circuit 12 receives the write-in command and display updating data from MCU 21; then, control circuit 12 follows the new write-in command to control driving circuit 16 to leave the idle state and drive display panel 30 to update screen. In this embodiment, the time interval between MCU 21 outputs write-in command and display updating data is, for example, one second; of course, in other embodiments, the time interval may change according to the polarization resistance of liquid crystal materials and for display screen requirements. The display screen updating method disclosed by this embodiment may avoid the display panel from displaying incomplete image picture without the necessity of equipping synchronization circuit, therefore, no cost increasing, issue involved. The display updating method of the present application may be applied to high frame-ratio to improve the screen displaying quality, or applied to low frame-ratio to save power consumed.

Figure 3:
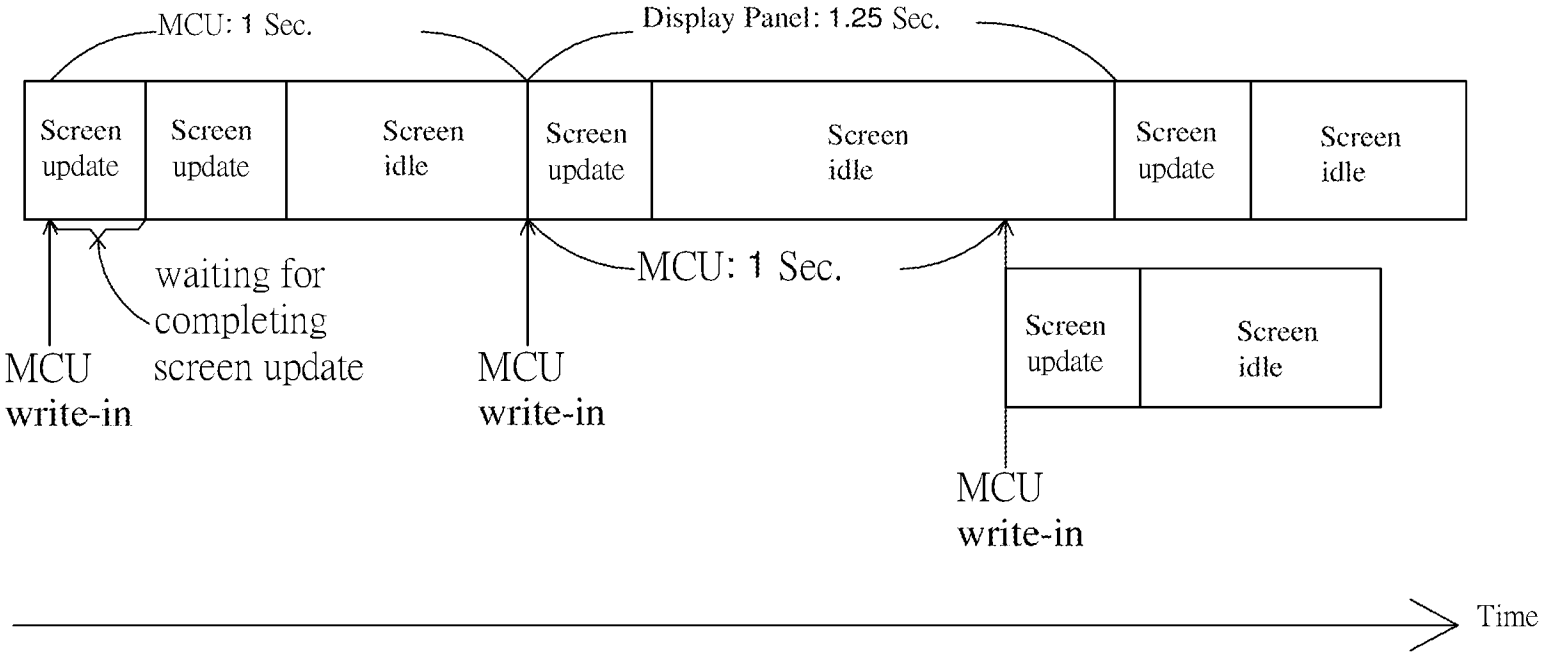
FIG. 3 shows a timing diagram of the method in updating the screen in the second embodiment of the present application.

In the present application, the screen image updating method of display panel in the second embodiment is shown in FIG. 3; in this embodiment, the portion identical to the former embodiment is not to be repeated herein; the similar devices also use the similar names and tag numbers, we merely illustrate the different portion. In this embodiment, the screen updating method of display panel in the present application is that when MCU 21 of host 2 transmits write-in command and display data to control circuit 12, if control circuit 12 has controlled driving circuit 16 to be within the state-updating duration of a preset frame period, that is, control circuit 12 is transmitting the display data previously transmitted by MCU 21 to driving circuit 16, controlling driving circuit 16 to drive display panel 30 and update the screen displayed by display panel 30, now control circuit 12 will control driving circuit 16 to continue to drive display panel 30 to display the complete screen image picture according to the pervious display data, then, provide updating data to driving circuit 16 according to the write-in command, for enabling the driving circuit 16 to drive display panel 30 to update screen image according to the updating data. Thus, display panel 30 may display the complete image picture and won't display an incomplete one, that is, the displayed screen won't be the case of partially previous screen image picture (corresponding to previous display data) and partially new one (corresponding to updated display data).

In this embodiment, if MCU 21 transmits write-in command and display data to control circuit 12, driving circuit 16 and display panel 30 are in an idle state within a preset idling period, control circuit 12 will provide the updated display data read from storage element 14 to the driving circuit 16, which follows the write-in command controlling driving circuit 16 to leave the idle state; driving circuit 16 follows the updated display data driving display panel 30 to update screen.

In an embodiment of the present application, it may set the first frequency of first pulse signal CLK1 to be great than the second frequency of second pulse signal CLK2; for example, the frequency of driving circuit 16 driving display panel 30 to update screen is 0.8 Hz (second frequency), and the frequency of MCU 21 outputting the write-in command and display data to control circuit 12 is 1.0 Hz (first frequency), thus, if proper updating duration is set, that is, the time that driving circuit 16 is in updating state and drives display panel 30 to update the display screen, it can result in that only when MCU 21 is first transmitting write-in command and display data to control circuit 12, it may meet control circuit 12 that has already controlled driving circuit 16 into the updating state of preset frame period, and MCU 21 subsequently follows the first pulse signal CLK1 once again sending the write-in command and display data to control circuit 12, which will happen when both driving circuit 16 and display panel 30 are in idle state; even passing through the preset frame period, for example, 1.25 second, MCU 21 still doesn't send the write-in command and display data to control circuit 12, control circuit 12 still follows 0.8 Hz frequency to read the presently stored display data of storage element 14, providing it to driving circuit 16; and driving circuit 16 follows the presently stored data of storage element 14 driving display panel 30 to display screen image; thus, display panel 30 may display complete screen image picture without displaying the incomplete one. In this embodiment, because the frame period is preset, therefore even control circuit 12 fails to receive write-in command and display updating data over a frame period time; it still will enjoy the advantage of automatically coming to the updating state to avoid the polarization of liquid crystal material display panel 30.

Figure 4:
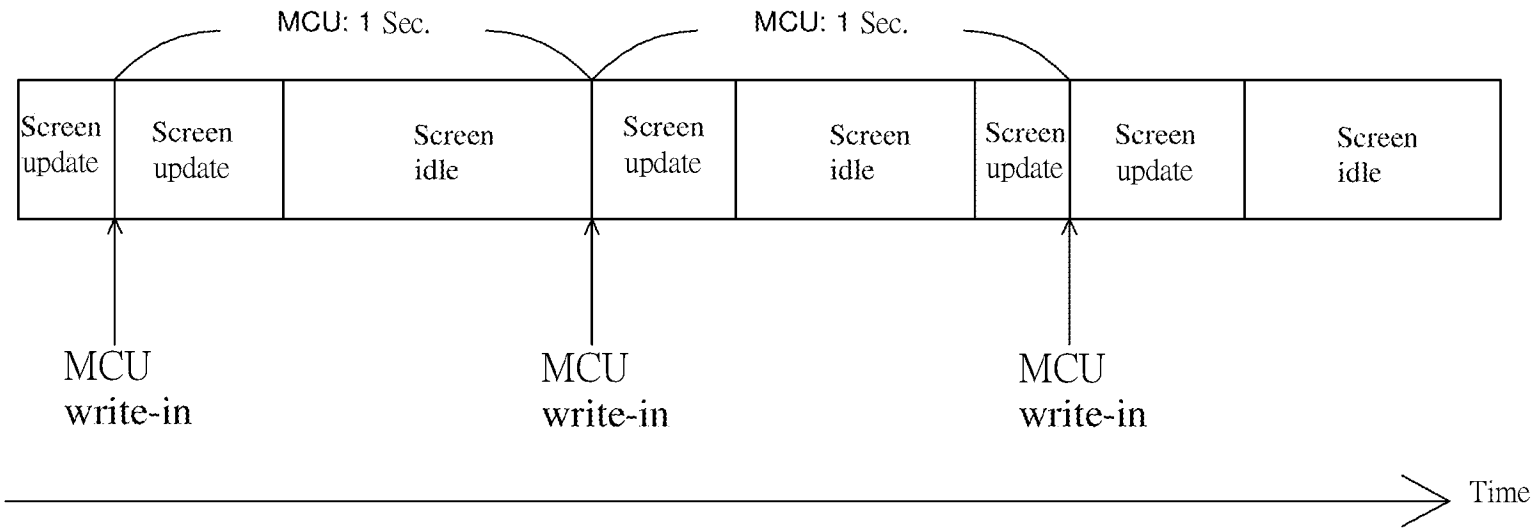
FIG. 4 shows a timing diagram of the method in updating the screen in the third embodiment of the present application.

In the present application, the screen image updating method of display panel in the third embodiment is shown in FIG. 4; in this embodiment, the portion identical to the former embodiment is not to be repeated herein; the similar devices also use the similar names and tag numbers, we merely illustrate the different portion. In this embodiment, a preset frame period includes an updating period and an idle period; the updating period is the time that driving device 10 is in an updating state; the idle period is the time that driving device 10 is in an idling state. When MCU 21 of host 2 transmits write-in command and display data to control circuit 12, if control circuit 12 has controlled driving circuit 16 to come into updating state, control circuit 12 will control driving circuit 16 to stop driving display panel 30 to update present screen, instead, it controls driving circuit 16 following the display updating data transmitted from MCU 21 driving display panel 30 to update display screen, which is equivalent to re-perform display-screen-updating. When MCU 21 of host 2 transmits write-in command and display data to control circuit 12, if control circuit 12 has controlled driving circuit 16 to come into idle state, control circuit 12 follows the write-in command received from MCU 21, controlling driving circuit 16 to leave idle state and provide the display updating data it read from storage element 14 to the driving circuit 16, controlling driving circuit 16 to follow the updated display data driving display Panel 30 to update display screen.

In this embodiment, control circuit 12 follows write-in command controlling driving circuit 16 to follow the display data sent from control circuit 12, driving display panel 30 to update the screen displayed by display panel 30, which no need to consider the frequency of MCU 21 transmitting write-in command and display data, and the frequency of driving circuit 16 driving display panel 30 to update display screen.

To sum up, the present application is a display screen updating method and its driving device, which controls the driving circuit driving the display panel to update the screen according to the write-in command, so that the frequency of the display data transmitted by the host is different from the driving circuit driving the display panel. The frequency of screen updating may prevent the display panel from displaying incomplete screen image pictures and improve the display quality.

However, the above statements are only a preferred embodiment of the present application, which is not used to limit the implementation scope of the present application; all the shapes, structures, features and spirits described in the claims of the present application listed under equal changes and modifications shall be included in the claims of the present application.

The present application is based on the fact that it is innovative, progressive and available for industrial use. Undoubtedly it can meet the patent application requirements stipulated by national Patent Act, we hereby apply for the invention patent application according to the law and sincerely anticipate your prompt approval.

The invention claimed is:

1. A screen updating method for a display, comprising:

controlling a driving circuit to drive a display panel to update a screen according to a write-in command;

wherein the write-in command represents writing a display data to a storage element, a start time point of controlling the driving circuit to drive the display panel to update the screen is determined according to the write-in command.

2. The screen updating method for the display of claim 1, further controlling the driving circuit to enter an updating state and drive the display panel to update the screen according to the write-in command.

3. The screen updating method for the display of claim 1, further comprising the driving circuit entering an idle state, and the display panel keeping and remaining the updated screen during the idling duration after the display panel has been driven to update the screen by the driving circuit.

4. The screen updating method for the display of claim 3, in which during the time period that the driving circuit enters into the idle state, controlling the driving circuit to leave the idle state according to the next write-in command for driving the display panel to update its screen displayed.

5. The screen updating method for the display of claim 3, in which the driving circuit keeps in the idle state until controlling the driving circuit according to the next write-in command to drive the display panel to update its screen displayed.

6. The screen updating method for the display of claim 3, in which the driving circuit is in the idle state within a preset idle period.

7. The screen updating method for the display of claim 6, in which the driving circuit is in the idle state within the preset idle period, the driving circuit is controlled according to the next write-in command to leave the idle state for driving the display panel to update its screen displayed.

8. The screen updating method for the display of claim 6, after the preset idle period, the driving circuit drives the display panel to update its screen displayed.

9. The screen updating method for the display of claim 8, after the preset idle period and during the time period that the driving circuit drives the display panel to update its screen displayed, the driving circuit is controlled according to the next write-in command to drive the display panel to stop the present screen updating, and re-perform screen updating.

10. The screen updating method for the display of claim 1, in which before controlling the driving circuit to drive the display panel performing screen updating according to the write-in command, if the driving circuit has driven the display panel to update screen, the driving circuit first completes the updating of present screen, then, continues to drive the display panel to make screen updating according to the write-in command, again.

11. The screen updating method for the display of claim 1, further reading the display data from the storage element and sending the display data to the driving circuit for driving the display panel to update the screen.

12. The screen updating method for the display of claim 1, in which the write-in command and the display data are transmitted by a host, the host sends the write-in command to update the display data, and the frequency of updating the display data is different from the frequency of the driving circuit driving the display panel to update the screen.

13. A driving device for a display, including:

A driving circuit, coupled to a display panel, driving the display panel to update a screen; and A control circuit, receiving a write-in command and a display data, coupled to the driving circuit, writing the display data into a storage element according to the write-in command, and controlling the driving circuit for driving the display panel to update the screen according to the write-in command, wherein a start time point of controlling the driving circuit to drive the display panel to update the screen is determined by the control circuit according to the write-in command.

14. The driving device for the display of claim 13, in which the control circuit controls the driving circuit to enter into an updating state according to the write-in command, for driving the display panel to update the screen.

15. The driving device for the display of claim 13, in which the driving circuit drives the display panel to update the screen; after that, the driving circuit enters into an idle state; during the idle state period, the updating screen displayed by the display panel remains unchanged.

16. The driving device for the display of claim 15, in which during the time period that the driving circuit enters into the idle state, the control circuit controls the driving circuit according to the next write-in command to leave the idle state for driving the display panel to update the screen.

17. The driving device for the display of claim 15, in which the driving circuit remains in the idle state until the control circuit controls the driving circuit according to the next write-in command to drive the display panel to update the screen.

18. The driving device for the display of claim 15, in which the driving circuit is in the idle state during a preset idle time period.

19. The driving device for the display of claim 18, in which the driving circuit is in the idle state during the preset idle time period; the control circuit controls the driving circuit according to the next write-in command to leave the idle state to drive the display panel to update the screen.

20. The driving device for the display of claim 18, in which after the preset idle time period, the driving circuit drives the display panel to update the screen.

21. The driving device for the display of claim 20, in which after the preset idle time period and during the time period that the driving circuit drives the display panel to update the screen, the control circuit controls the driving circuit according to the next write-in command to drive the display panel to stop the present screen updating and re-perform screen updating.

22. The driving device for the display of claim 13, in which before the control circuit controlling the driving circuit to drive the display panel to update screen according to the write-in command, if the driving circuit has driven the display panel to update screen, the driving circuit first completes the present screen-updating, then, the control circuit goes on controlling the driving circuit in driving the display panel to re-update the screen according to the write-in command, again.

23. The driving device for the display of claim 13, in which the control circuit reads the display data from the storage element and sends it to the driving circuit for driving the display panel to update screen.

24. The driving device for the display of claim 13, in which the write-in command and the display data are sent by a host, the host transmits the write-in command to update the display data, the frequency of updating the display data is different from the frequency of the driving circuit driving the display panel to update the screen.

25. The driving device for the display of claim 24, in which the host transmits the write-in command to update the display data, the frequency of updating display data is larger than the frequency of the driving circuit driving the display panel to update the screen.

* * * * *